United States Patent [19]

Mascetti

[11] Patent Number: 4,567,739

[45] Date of Patent: Feb. 4, 1986

[54] PLATFORM FOR INTRODUCING SHEET MATERIALS, PARTICULARLY IN LEATHER SPLITTING MACHINES AND THE LIKE

[76] Inventor: Paolo Mascetti, Via Rovani, 11, Milan, Italy

[21] Appl. No.: 589,168

[22] Filed: Mar. 13, 1984

[51] Int. Cl.[4] ..... C14B 1/18; C14B 17/04; C14B 17/06

[52] U.S. Cl. ..... 69/10; 69/47; 83/871; 83/874

[58] Field of Search ..... 69/9, 10, 12, 15, 16, 69/21.5, 44, 47; 83/871, 872, 873, 874

[56] References Cited

U.S. PATENT DOCUMENTS

| | | | |
|---|---|---|---|
| 175,389 | 3/1876 | Stimpson | 69/9 |
| 488,212 | 12/1892 | Masterson | 69/15 X |
| 1,225,900 | 5/1917 | Webster | 69/12 |
| 1,643,089 | 9/1927 | Ray et al. | 69/21.5 X |
| 1,670,514 | 5/1928 | Lane | 83/871 X |
| 2,404,731 | 7/1946 | Johnson | 69/10 X |

FOREIGN PATENT DOCUMENTS

| | | | |
|---|---|---|---|
| 535702 | 1/1922 | France | 69/12 |

*Primary Examiner*—Wm. Carter Reynolds
*Attorney, Agent, or Firm*—Darby & Darby

[57] ABSTRACT

Platform for introducing sheet materials, particularly in leather splitting machines and the like, consisting of a plate suitable to slide in a reciprocating manner on a fixed level disposed at the top of a bearing structure. Balls are interposed between said plate and the fixed level for the purpose of assisting the sliding of the plate itself which is also provided with a guide block that engages into a rectilinear guide obtained on said fixed level, two rows of balls being interposed therebetween. In addition, said plate is provided with means causing the automatic return of the same to its starting position.

4 Claims, 3 Drawing Figures

PLATFORM FOR INTRODUCING SHEET MATERIALS, PARTICULARLY IN LEATHER SPLITTING MACHINES AND THE LIKE

FIELD AND BACKGROUND OF THE INVENTION

The present invention pertains to a platform for introducing sheet materials, particularly in leather splitting machines and the like.

It is known that splitting machines consist of a band blade disposed around a pair of flywheels, at least one of which is a drive flywheel, provided with axes substantially parallel to each other. The working to be carried out on the sheet material is splitting, that is a longitudinal thinning cut that causes a reduction in the thickness of leather.

In order to achieve this type of working, the material is introduced into the machine in correspondence of the rectilinear sharp portion of the blade from a positioning platform placed in front of said cutting edge. As soon as the cutting operation begins, a pair of feed rollers, disposed close to said rectilinear portion of blade, cause the cut material to move forward.

The conventional platforms for introducing said material consist of a fixed plate mounted on a bearing surface disposed in front of the rectilinear operating portion of the blade. These plates are provided with a very smooth working surface as the material must easily slide thereon, which enables its introduction into the cutting area.

Such an arrangement however, although very expensive, does not ensure a sufficient smoothness when the material to be treated has a high friction coefficient or in any case such a coefficient that a hard sliding is caused.

In these cases in fact when the material is caused to slide along the platform in order to be introduced into the cutting area, it tends to "jib" so that it is brought into contact with the blade under a faulty spreading condition which obviously produces an uneven reduction in the thickness of the leather to be worked.

Still bigger drawbacks occur when workings on leather have to be carried out on dies. It is known that dies are substantially flat patterns having the same shape as the piece to be worked, provided underneath with circumferential and/or central swellings suitable to exert a stronger pressure against the leather situated below so that, after the working, the leather thickness appears more reduced close to the circumferential edge or in the central portions where the above mentioned swellings are present on the die.

It is obvious that on a fixed platform, if hardly sliding materials are concerned, when the material is caused to slide with the die placed thereon in order to introduce it into the cutting area, there is inevitably the occurrence of relative motions between the die and the leather to be worked. Due to these slippings, the machine cannot work correctly, so that the reductions in thickness are not so accurate as it is in some cases required.

In order to obviate these inconveniences, a platform for the introduction of the material has been envisaged, which is provided with a plurality of rollers pivotally mounted on axes parallel to the rectilinear portion of the blade. However, such a platform is, on the one hand, very expensive while, on the other hand, it does not completely solve the problem related to the introduction of leather into the cutting area under a perfect-spreading condition. In fact, the rollers are so shaped that they do not ensure a complete backing for the leather while it is being introduced, so that some portions will always be cut "under measure" and others "over-measure".

OBJECT

It is therefore a main object of the present invention to obviate the above mentioned drawbacks, providing a platform for the introduction of sheet materials particularly in leather splitting machines and the like which allows the material to be introduced under the best spreading conditions thus avoiding the occurrence of difficulties as to the sliding thereof.

SUMMARY OF THE INVENTION

This and still further objects which will become more apparent from the following description are achieved, according to the present invention, by a platform for introducing sheet materials, particularly in leather splitting machines and the like, of the kind in which a band blade is provided which runs on a pair of flywheels of substantially parallel axes and having a rectilinear operating portion disposed close to a pair of feed rollers for the material being worked, characterized in that it comprises, on a fixed level disposed at the top of a bearing structure, a plate slidably mounted within at least a rectilinear guide disposed at right angles to the rectilinear operating portion of the blade and movable from one position disposed at some distance from the blade where said material is correctly positioned, to a second position disposed close to the operating portion of said blade, where the material is introduced in order to reduce the thickness thereof, said plate being associated with means suitable to cause the return of the same to said first position from the piece to be worked has been withdrawn by the machine feed means.

Advantageously, in order to allow the plate to slide under the best smoothness conditions, the latter is caused to slide on some balls housed in corresponding housings carried by the bearing structure, the parallelism of the reciprocating motions of said introduction platform being also maintained by means of an interposed-ball coupling.

BRIEF DESCRIPTION OF THE DRAWINGS

Further features and advantages of the invention will best be understood from the detailed description of a preferred, and not restrictive, embodiment of a platform for introducing sheet materials particularly in leather splitting machines and the like, according to the present invention, given hereinafter with reference to the accompanying drawings, in which.

DETAILED DESCRIPTION OF A PREFERRED EMBODIMENT

Figure 1:
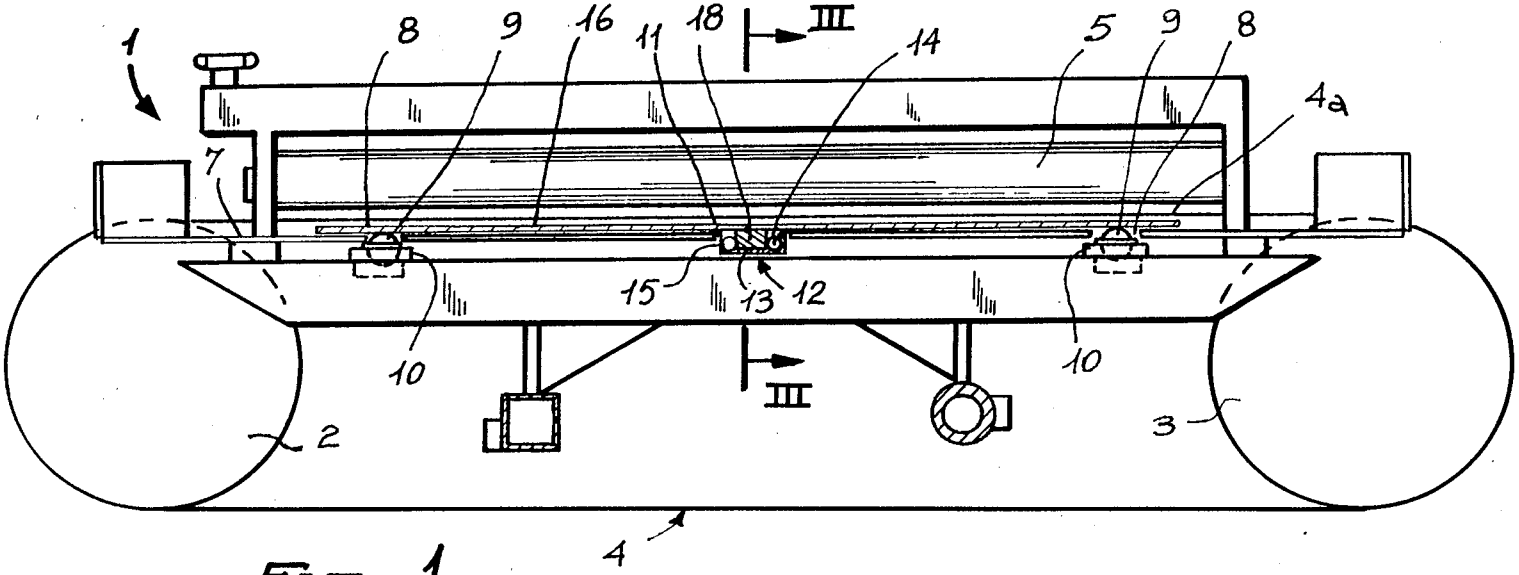
FIG. 1 is a part-sectional elevation front view of the platform according to the present invention.

Referring to the drawings, and particularly to FIG. 1, it has been generally indicated at 1 a splitting machine of the conventional type consisting of a pair of flywheels 2 and 3, one of which is a drive flywheel, around which a band blade 4 runs.

In correspondence of the rectilinear operating portion 4*a* of blade 4, there is provided a pair of rollers 5 only one of them being shown in FIG. 1. They are disposed above each other and are suitable to cause the material being worked to move forward in proportion as it must be cut. In the part of the machine that is in front of blade 4 a bearing structure 6 carries a fixed level 7 at the top.

The fixed level 7 is provided with a plurality of holes 8 from which the balls 9 project, said balls being rotatably housed in corresponding housings 10 disposed at the top of the bearing structure 6. The fixed level 7 is centrally provided with a slit 11 into which is fitted a guide 12 carried by the bearing structure 6. Said guide 12 substantially consists of an elongated upwardly-open box-shaped body 13 which houses two rows of balls 14 and 15 along its side walls. A sliding plate 16 is provided on said fixed level 7: according to the present invention, it constitutes the introduction surface for sheet materials, such as hides, leather and the like, into the splitting machine 1.

The plate 16 rests on the balls 9 that partially project from the fixed level 7 and it is provided, underneath, with a sliding block 18 designed to be fitted between the ball rows 14 and 15 of guide 12. In this manner, as it is clearly seen in FIGS. 1 and 2, plate 16 has no parts in direct contact either with the fixed level 7 or with the bearing structure 6 but it always has ball-shaped members disposed therebetween, which makes the smooth running of the material introduction platform much easier.

Figure 2:
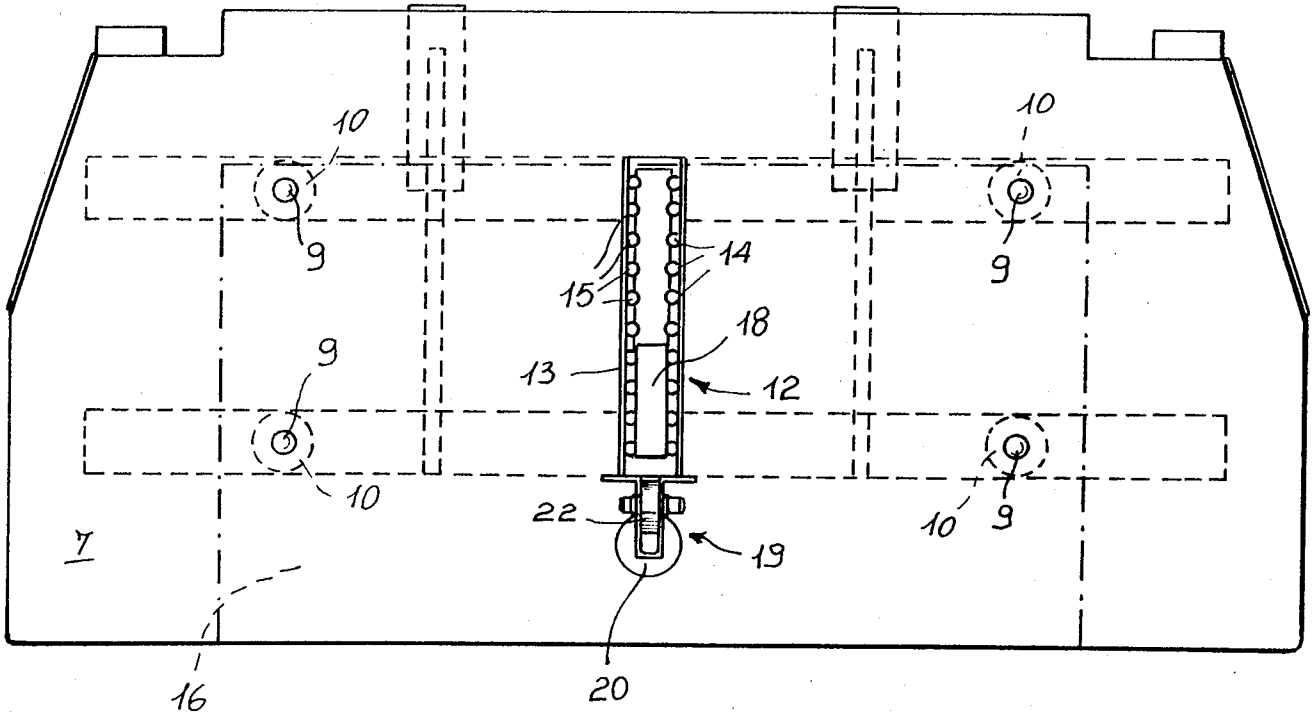
FIG. 2 is a plan view of the platform shown in FIG. 1.

It should be observed that in FIG. 2 plate 16 has been shown in chain dot line, in order to allow the best view of the ball-shaped members which are in direct contact with the plate itself. Therefore, the introduction platform for said sheet materials according to the present invention can be slidably displaced from one position, situated at some distance from the operating portion 4*a* of the band blade 4, to a second position situated in correspondance of said operating blade portion 4*a*.

Figure 3:
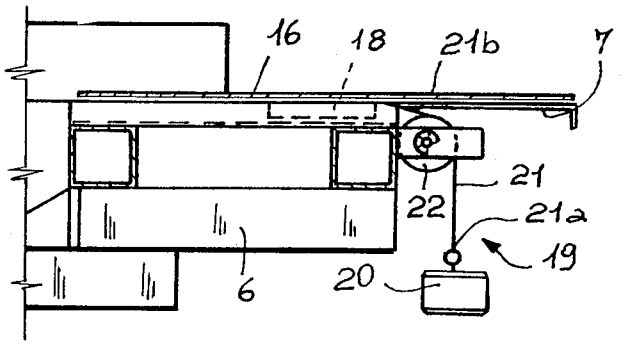
FIG. 3 is a sectional view taken along the line III—III in FIG. 1.

Referring particularly to FIG. 3 and according to a further feature of the invention, it has been generally indicated at 19 a means suitable to cause the return of plate 16 from said second position to its first position after the piece to be worked has been withdrawn by the feed rollers 5 of the splitting machine 1. As it is possible to see in said figure, this means consists of a counterweight 20 to which is secured one end 21*a* of a cord 21. The cord 21 runs over the race of a pulley 22 supported by the bearing structure 6 and is connected, at the other end 21*b* thereof, to the sliding block 18 integral to plate 16.

After the above description, the operation of the platform for introducing sheet materials according to the present invention appears very easy.

The platform being in its first position, that is at some distance from the rectilinear operating position 4*a* of the band blade 4, the material to be worked is positioned. Obviously, should a die be necessary, the latter must be disposed upon the material. After carrying out this preliminary operation, the plate 16 is pushed forward by hand towards the rectilinear operating portion 4*a* of the band blade 4, i.e. it is brought to its second position. Here the material is caught by the feed rollers 5 and caused to move forward by the same which bring it into contact with blade 4 for cutting.

Once the material has been released by the operator, plate 16 goes automatically back to its first position under the action exerted by the counterweight 20 shown in FIG. 3.

The invention thus attains the intended purposes in a very easy and cheap manner.

It is understood that many modifications of a practical and technical nature may be made to the platform for introducing sheet materials according to the present invention without in any way departing from the scope and spirit of the invention itself.

What is claimed is as follows:

1. A platform for introducing sheet materials, particularly in leather splitting machines and the like, of the kind in which a band blade (4) is provided which runs on a pair of flywheels (2, 3) of substantially parallel axes and having a rectilinear operating portion (4*a*) disposed close to a pair of feed rollers (5) for the material being worked, characterized in that it comprises, on a fixed level (7) disposed at the top of a bearing structure (6), a plate (16) slidably mounted within at least a rectilinear guide (12) disposed at right angles to the rectilinear operating portion (4*a*) of the blade (4) and movable from one position disposed at some distance from the blade (4), where said material is correctly positioned, to a second position disposed close to the operating portion (4*a*) of said blade (4), where the material is introduced in order to reduce the thickness thereof, said plate (16) being associated with means (19) suitable to cause the return of the same to said first position after the piece to be worked has been withdrawn by the machine feed means.

2. A platform according to claim 1, characterized in that holes (8) are provided on the fixed level (7) that is below plate (16), from which holes partially project balls (9) that are rotatably housed in corresponding housings (10) suitably mounted on the bearing structure (6) of the machine, said plate (16) resting on said balls.

3. A platform according to claim 1, characterized in that said means (19) that causes the return of plate (16) to its first position consists of a counterweight (20) connected to one end (21*a*) of a cord (21), the other end (21*b*) of which is connected to said guide block (18) of plate (16), said cord (21) being engaged, along its intermediate portion, within the race of a pulley (22) supported by the bearing structure (6) below said plate (16).

4. A platform for introducing sheet materials, particularly in leather splitting machines and the like, of the kind in which a band blade (4) is provided which runs on a pair of flywheels (2, 3) of substantially parallel axes and having a rectilinear operating portion (4*a*) disposed close to a pair of feed rollers (5) for the material being worked, characterized in that it comprises, on a fixed level (7) disposed at the top of a bearing structure (6), a plate (16) slidably mounted within at least a rectilinear guide (12) disposed at right angles to the rectilinear operating portion (4*a*) of the blade (4) and movable from one position disposed at some distance from the blade (4), where said material is correctly positioned, to a second position disposed close to the operating portion (4*a*) of said blade (4), where the material is introduced in order to reduce the thickness thereof, said plate (16) being associated with means (19) suitable to cause the return of the same to said first position after the piece to be worked has been withdrawn by the machine feed means, said rectilinear guide including an elongated upwardly-open box-shaped body (13) which is fitted into a slit (11) obtained in the fixed level (7) which is below the plate (16), said box-shaped body (13) having side walls and having two rows of balls (14–15) rotatably housed on the side walls, and a guide block (18) slidably engaged between said rows and fixedly mounted on the lower part of plate (16).

* * * * *